US010022287B2

(12) United States Patent
Shimada et al.

(10) Patent No.: US 10,022,287 B2
(45) Date of Patent: Jul. 17, 2018

(54) WALKING TRAINING SYSTEM AND WALKING TRAINING METHOD OF THE SAME

(71) Applicant: TOYOTA JIDOSHA KABUSHIKI KAISHA, Toyota-shi, Aichi-ken (JP)

(72) Inventors: Hiroshi Shimada, Tajimi (JP); Masayuki Imaida, Ichinomiya (JP); Hitoshi Konosu, Nagoya (JP); Yoshinori Fujikake, Nagakute (JP); Issei Nakashima, Toyota (JP); Eiichi Saitoh, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 416 days.

(21) Appl. No.: 14/717,275

(22) Filed: May 20, 2015

(65) Prior Publication Data

US 2015/0342819 A1 Dec. 3, 2015

(30) Foreign Application Priority Data

May 27, 2014 (JP) ..... 2014-109471

(51) Int. Cl.
*A63B 22/00* (2006.01)
*A61H 3/00* (2006.01)
(Continued)

(52) U.S. Cl.
CPC ..... *A61H 3/00* (2013.01); *A61H 1/024* (2013.01); *A63B 21/4011* (2015.10); *A63B 22/02* (2013.01); *A63B 69/0028* (2013.01); *A61H 1/0262* (2013.01); *A61H 3/008* (2013.01); *A61H 2201/1261* (2013.01); *A61H 2201/149* (2013.01); *A61H 2201/165* (2013.01); *A61H 2201/1642* (2013.01); *A61H 2201/1664* (2013.01); *A61H 2201/1671* (2013.01); *A61H 2201/5061* (2013.01);
(Continued)

(58) Field of Classification Search
None
See application file for complete search history.

(56) References Cited

U.S. PATENT DOCUMENTS 6,821,233 B1 11/2004 Colombo et al.
7,462,138 B2 * 12/2008 Shetty ..... A61H 3/008 482/51
(Continued)

FOREIGN PATENT DOCUMENTS

CN 201150623 Y 11/2008
DE 10 2010 051 083 A1 8/2011
(Continued)

*Primary Examiner* — Stephen R Crow
(74) *Attorney, Agent, or Firm* — Oliff PLC

(57) ABSTRACT

A walking training system includes a walking assistance apparatus that is mounted on a leg portion of a user, and assists the user's walking, first pulling means for pulling at least one of the walking assistance apparatus and the leg portion of the user to a front side; and second pulling means for pulling at least one of the walking assistance apparatus and the leg portion of the user to a rear side. A pulling point of the walking assistance apparatus and/or the leg portion of the user, which is pulled by the first and second pulling means is provided to be movable around the leg portion of the user.

9 Claims, 7 Drawing Sheets

(51) Int. Cl.

| | |
|---|---|
| ***A63B 69/00*** | (2006.01) |
| ***A63B 22/02*** | (2006.01) |
| ***A63B 21/00*** | (2006.01) |
| *A61H 1/02* | (2006.01) |
| *A63B 24/00* | (2006.01) |

(52) U.S. Cl.
CPC .. *A61H 2203/0406* (2013.01); *A61H 2205/10* (2013.01); *A63B 2024/0093* (2013.01)

(56) References Cited

U.S. PATENT DOCUMENTS

| | | | | |
|---|---|---|---|---|
| 7,494,450 | B2 * | 2/2009 | Solomon | A61H 1/0229 482/51 |
| 9,259,603 | B2 * | 2/2016 | Wireman | A63B 5/16 |
| 9,314,658 | B2 * | 4/2016 | Kaye | A63B 21/0557 |
| 9,358,413 | B2 * | 6/2016 | Verdi | A63B 71/023 |
| 9,433,819 | B1 * | 9/2016 | Carducci | A63B 22/0285 |
| 9,700,751 | B2 * | 7/2017 | Verdi | A63B 21/4019 |
| 2004/0087418 | A1 | 5/2004 | Eldridge | |
| 2013/0137553 | A1 * | 5/2013 | Kim | A63B 21/4007 482/69 |
| 2013/0225371 | A1 | 8/2013 | Harrer et al. | |
| 2015/0320632 | A1 * | 11/2015 | Vallery | A61H 3/008 482/69 |
| 2015/0342820 | A1 | 12/2015 | Shimada et al. | |

FOREIGN PATENT DOCUMENTS

| | | | |
|---|---|---|---|
| JP | 2009-183657 | A | 8/2009 |
| JP | 2012-165822 | A | 9/2012 |
| JP | 2013-543749 | A | 12/2013 |
| JP | 2015-223294 | A | 12/2015 |
| WO | 2009/013838 | A1 | 1/2009 |
| WO | 2014/001853 | A1 | 1/2014 |

* cited by examiner

WALKING TRAINING SYSTEM AND WALKING TRAINING METHOD OF THE SAME

INCORPORATION BY REFERENCE

This application is based upon and claims the benefit of priority from Japanese patent application No. 2014-109471, filed on May 27, 2014, the disclosure of which is incorporated herein in its entirety by reference.

BACKGROUND OF THE INVENTION

1. Field of the Invention

The present invention is related to a walking training system and a walking training method thereof such that a user performs walking training.

2. Description of Related Art

There is a walking training system which is provided with a band assisting the starting movement of a leg portion by pulling the leg portion of a user walking on a treadmill to the front side (refer to Japanese Unexamined Patent Application Publication No. 2009-183657).

Incidentally, during the walking training of the user, for example, there may be a tendency that the leg portion is internally rotated or externally rotated. However, it is difficult for the above-described walking training system to adjust an amount of internal rotation and an amount of external rotation of the leg portion since the walking training system only pulls the leg portion of the user to the front side so as to assist the starting movement.

SUMMARY OF THE INVENTION

The present invention has been made in order to solve the above described problem, and an object of the present invention is to provide a walking training system, and a walking training method thereof which can adjust a control amount of the internal and external rotation of a leg portion while assisting the user's walking during the walking training.

An aspect of the present invention to achieve the object stated above is a walking training system comprising:

a walking assistance apparatus that is mounted on a leg portion of a user, and assists the user's walking;

first pulling means for pulling at least one of the walking assistance apparatus and the leg portion of the user to a front side; and second pulling means for pulling at least one of the walking assistance apparatus and the leg portion of the user to a rear side, wherein a pulling point of the walking assistance apparatus and/or the leg portion of the user, which is pulled by the first and second pulling means is provided to be movable around the leg portion of the user.

In this aspect, the pulling point of the first pulling means may be set to an outside of the leg portion the user and/or the pulling point of the second pulling means may be set to an inside of the leg portion of the user.

In this aspect, the pulling point of the first pulling means may be set to an inside of the leg portion of the user and/or the pulling point of the second pulling means may be set to an outside of the leg portion of the user.

In this aspect, each of the first and second pulling means may include a wire of which an end is attached to at least one of the walking assistance apparatus and the leg portion of the user, and a pulling unit that pulls the wire, and the pulling unit may be provided to be movable in the horizontal direction.

In this aspect, the first pulling means may pull at least one of the walking assistance apparatus and the leg portion of the user to the upper side and the front side, and the second pulling means may pull at least one of the walking assistance apparatus and the leg portion of the user to the upper side and the rear side.

In this aspect, the walking training system may further comprise control means for independently controlling a pulling force of the first pulling means and a pulling force of the second pulling means.

In this aspect, a resultant force of components in the vertically upward direction from the pulling forces which are generated by the first and second pulling means may be equal to the force of gravity of the walking assistance apparatus.

An aspect of the present invention to achieve the object stated above is a walking training system comprising:

a walking assistance apparatus that is mounted on a leg portion of a user, and assists the user's walking;

first pulling means for pulling at least one of the walking assistance apparatus and the leg portion of the user to a front side; and second pulling means for pulling at least one of the walking assistance apparatus and the leg portion of the user to a rear side, wherein each of the first and second pulling means includes a wire of which an end is attached to at least one of the walking assistance apparatus and the leg portion of the user, and a pulling unit that pulls the wire, and at least one of the pulling units of the first and second pulling means is provided to be movable in the horizontal direction.

An aspect of the present invention to achieve the object stated above is a walking training method of a walking training system that includes a walking assistance apparatus that is mounted on a leg portion of a user, and assists the user's walking; first pulling means for pulling at least one of the walking assistance apparatus and the leg portion of the user to a front side; and second pulling means for pulling at least one of the walking assistance apparatus and the leg portion of the user to a rear side, the method comprising:

setting a pulling point of the walking assistance apparatus and/or the leg portion of the user, which is pulled by the first and second pulling means by moving the pulling point around the leg portion of the user. handle.

According to the invention, it is possible to provide a walking training system, and a walking training method thereof which can adjust a control amount of the internal and external rotation of a leg portion while assisting the user's walking during the walking training.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Hereinafter, embodiments of the present invention will be described with reference to the drawings.

Figure 1:
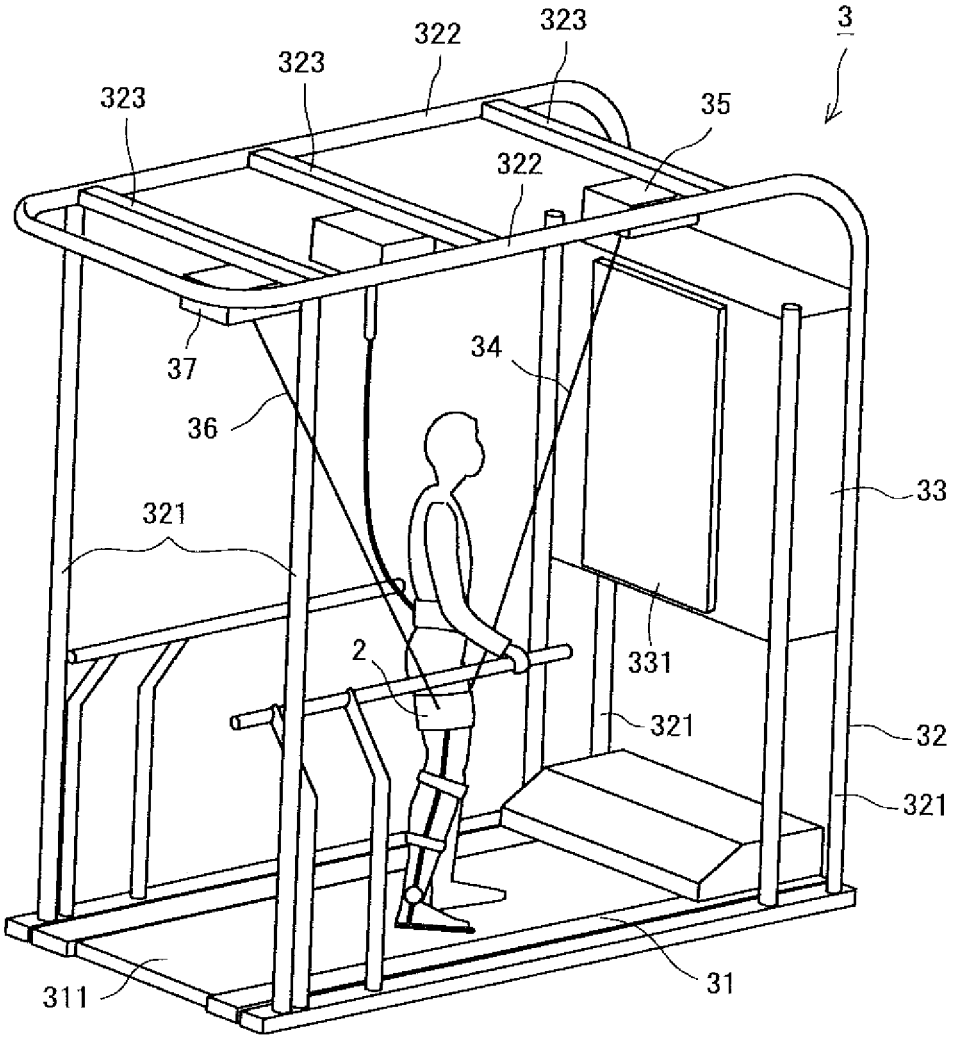
FIG. 1 is a perspective view illustrating a schematic configuration of a walking training system according to an embodiment of the invention.

FIG. 1 is a perspective view illustrating a schematic configuration of a walking training system according to a first embodiment of the invention. The walking training system 1 according to the present embodiment is an apparatus that performs walking training for a user, for example, a patient suffering from hemiplegia due to a stroke. The walking training system 1 is provided with a walking assistance apparatus 2 which is mounted on the leg portion of the user and a training apparatus 3 which performs the walking training for the user.

Figure 2:
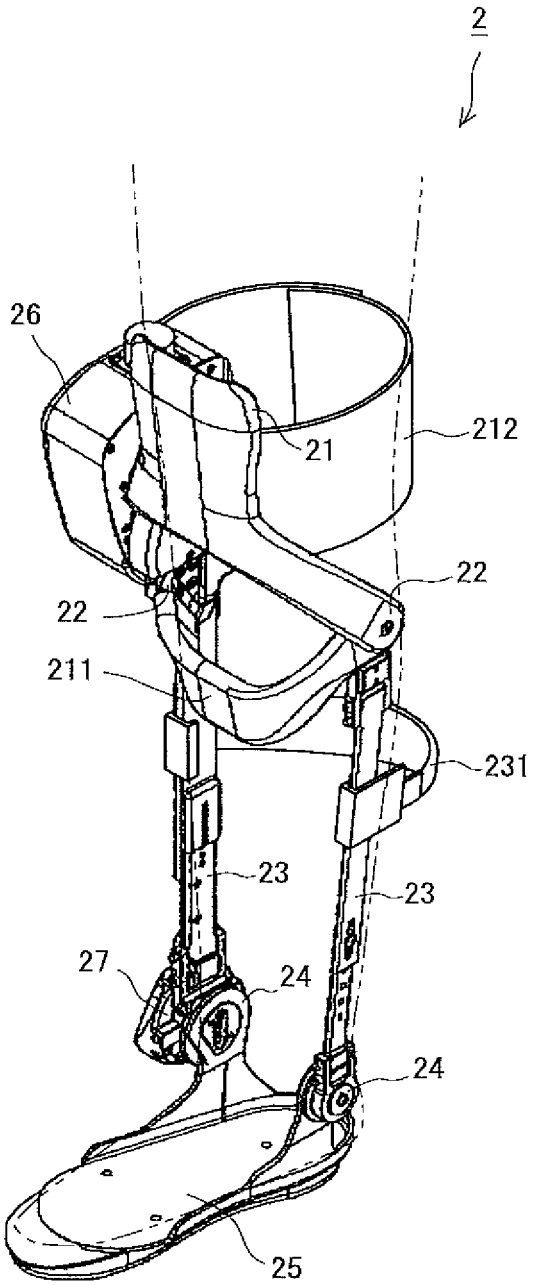
FIG. 2 is a perspective view illustrating a schematic configuration of a walking assistance apparatus according to the embodiment of the invention.

The walking assistance apparatus 2 is mounted on, for example, an affected leg of a user performing the walking training, and assists user's walking (FIG. 2). The walking assistance apparatus 2 includes an upper thigh frame 21, a lower thigh frame 23 which is connected to the upper thigh frame 21 via a knee joint portion 22, a foot palm frame 25 which is connected to the lower thigh frame 23 via an ankle joint portion 24, a motor unit 26 which rotatably drives the knee joint portion 22, and an adjusting mechanism 27 which adjusts a movable range of the ankle joint portion 24. Meanwhile, a configuration of the above-described walking assistance apparatus 2 is merely an example, thus the invention is not limited thereto. For example, the walking assistance apparatus 2 may be provided with a motor unit which rotatably drives the ankle joint portion 24.

The upper thigh frame 21 is attached to an upper thigh portion of the leg portion of the user, and the lower thigh frame 23 is attached to a lower thigh portion of the leg portion of the user. An upper thigh equipment 212, for example, is provided in the upper thigh frame so as to fix the upper thigh portion. The upper thigh equipment 212 is fixed to the upper thigh portion, for example, by using magic tape (Trade mark). With this, it is possible to prevent the walking assistance apparatus 2 from being deviated from the leg portion of the user in the horizontal direction or the vertical direction.

The upper thigh frame 21 is provided with a first frame 211 which is formed in a horizontally long shape, and extends in the horizontal direction so as to connect to a wire 34 of a first pulling unit 35 described later. The first frame 211 is provided with a plurality of connection portions in the horizontal direction so as to connect and pull the wire 34 of the first pulling unit 35. It is possible to move a pulling point of the first pulling unit 35 around the leg portion of the user by changing the connection portion which connects to the wire 34 of the first pulling unit 35.

The lower thigh frame 23 is provided with a second frame 231 which is formed in a horizontally long shape, and extends in the horizontal direction so as to connect to a wire 36 of a second pulling unit 37 described later. The second frame 231 is provided with a plurality of connection portions in the horizontal direction so as to connect to and pull the wire 36 of the second pulling unit 37. It is possible to move a pulling point of the second pulling unit 37 around the leg portion of the user by changing the connection portion which connects to the wire 36 of the second pulling unit 37.

Meanwhile, the connection portion of the first and second pulling units is one of examples, and thus the invention is not limited thereto. For example, the wires 34 and 36 of the first and second pulling units 35 and 37 may be connected to the upper thigh equipment, and if the pulling point of the first and second pulling units 35 and 37 can be moved around the leg portion of the user, the wires 34 and 36 may be connected to an optional position.

The motor unit 26 assists the user's walking by rotatably driving the knee joint portion 22 in accordance with the user's walking motion. Meanwhile, a configuration of the walking assistance apparatus 2 is one of examples, and thus the invention is not limited thereto. An optional walking assistance apparatus which is mounted on the leg portion of the user and can assist the user's walking can be adopted.

The training apparatus 3 includes a treadmill 31, a frame main body 32, and a control apparatus 33. The treadmill 31 causes a ring-like belt 311 to be rotated. The user performs the walking training by walking on the belt 311 in accordance with the movement of the belt 311.

The frame main body 32 includes two pairs of column frames 321 which are installed on the treadmill 31, a pair of front and rear frames 322 which are connected to each column frame 321 and extend in the longitudinal direction, and three right and left frames 323 which are connected to each front and rear frame 322 and extend in the horizontal direction. Meanwhile, a configuration of the frame main body 32 is not limited to the above description. If the first and second pulling units 35 and 37 which are described later can be properly fixed, the frame main body 32 may have an optional frame configuration.

The right and left frame 323 on the front side is provided with the first pulling unit 35 which pulls the wire 34 to the upper side and the front side. The right and left frame 323 on the rear side is provided with the second pulling unit 37 which pulls the wire 36 to the upper side and the rear side.

The first and second pulling units 35 and 37 are configured to have, for example, a mechanism which winds and rewinds the wires 34 and 36, a motor which drives the corresponding mechanism, or the like. An end of the wires 34 and 36 which is pulled by the first and second pulling units 35 and 37 is connected to the walking assistance apparatus 2. The first pulling unit 35 pulls the walking assistance apparatus 2 to the upper side and the front side by using the wire 34. The second pulling unit 37 pulls the walking assistance apparatus 2 to the upper side and the rear side by using the wire 36.

The first and second pulling units 35 and 37 control a driving torque of the motor so as to control the pulling force of the wires 34 and 36, but the invention is not limited thereto. For example, each of the wires 34 and 36 may be connected to a spring member, and thus the pulling force of the wires 34 and 36 may be adjusted by adjusting the elastic force of the spring member.

Figure 3:
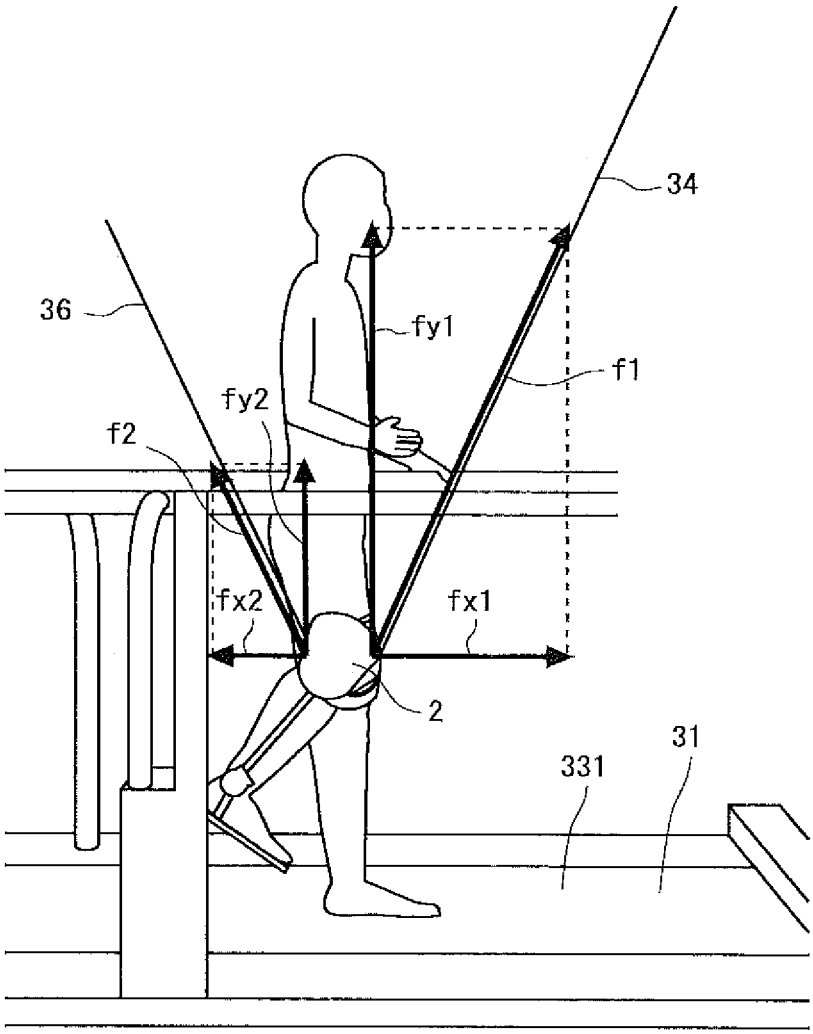
FIG. 3 is a diagram illustrating a pulling force by a first pulling unit and a second pulling unit.

Components fy1 and fy2 in the vertically upward direction from the pulling forces f1 and f2 which are generated by the first and second pulling units 35 and 37 support the weight of the walking assistance apparatus 2 (FIG. 3). In addition, components fx1 and fx2 in the horizontal direction of the pulling forces f1 and f2 which are generated by the first and second pulling units 35 and 37 assist the starting of the movement of the leg portion. Accordingly, it is possible to reduce a walking load of the user at the time of the walking training. In addition, each of the wires 34 and 36 extends to the upper side and the front side, and the upper side and the rear side from the walking assistance apparatus 2 mounted on the leg portion of the user. Therefore, each of the wires 34 and 36 does not interfere with the user's walking and thus does not interfere with the walking training.

The control apparatus 33 is a specific example of control means, and controls each of the pulling forces f1 and f2 of the first and second pulling units 35 and 37, the driving of the treadmill 31, and the walking assistance apparatus 2. The control apparatus 33 has a hardware configuration, for example, mainly including a microcomputer which is formed of a central processing unit (CPU) 51 which performs an operating process, a control process or the like, a read only memory (ROM) which stores an operation program performed by the CPU 51, a control program, or the like, a random access memory (RAM) which stores various items of data, an interface unit (I/F) which performs input and output of signals from the outside, and the like. The CPU, the ROM, the RAM, and the interface unit are connected to each other via a data bus.

The control apparatus 33 is provided with a display unit 331 which displays information of a training instruction, a training menu, training information (walking speed, biological information, or the like), or the like. The display unit 331 is configured as, for example, a touch panel, and the user can input the various items of information via the display unit 331.

The control apparatus 33 controls the pulling forces f1 and f2 of the first and second pulling units 35 and 37 such that the resultant force of the components (fy1+fy2) in the vertically upward direction from the pulling forces which are generated by the first and second pulling units 35 and 37 is equal to the weight of the walking assistance apparatus 2. Due to this, the user can naturally perform the walking training without feeling the weight of the walking assistance apparatus 2 which is mounted on the leg portion.

Further, the control apparatus 33 may control the pulling forces f1 and f2 of the first and second pulling units 35 and 37 and change the components fy1 and fy2 in the vertically upward direction from the pulling forces, and thus adjust a relief amount of the leg portion. Due to this, for example, it is possible to properly set the degree of difficulty of the walking training by adjusting the relief amount of the leg portion in accordance with a degree of recovery of a patient.

The control apparatus 33 may independently control each of the pulling force f1 of the first pulling unit 35 and the pulling force f2 of the second pulling unit 37. Due to this, separately from the relief amount of the leg portion in the vertically upward direction, it is possible to adjust an assist amount of the starting movement in the front and rear direction.

For example, the control apparatus 33 controls the pulling force f1 of the first pulling unit 35 to be greater than the pulling force f2 of the second pulling unit 37 as illustrated in FIG. 3. In this case, the resultant force of the components (fy1+fy2) in the vertically upward direction from the pulling forces of the first and second pulling units 35 and 37 corresponds to the relief amount of the leg portion in the vertically upward direction, and the resultant force of the components (fx1−fx2) in the horizontal direction of the pulling forces of the first and second pulling units 35 and 37 corresponds to the assist amount of the starting movement. In this way, the relief amount of the leg portion and the assist amount of the starting movement can be properly adjusted depending on the user, and thus it is possible to improve the efficiency of the walking training.

Incidentally, during the walking training of the user, there may be a tendency that the leg portion is internally rotated or externally rotated. For example, the affected leg is likely to be internally rotated in an early stage of rehabilitation and is likely to be externally rotated in a recovery stage, and since the weight of the walking assistance apparatus is also added to the affected leg, the above tendency becomes more significant.

In contrast, in the walking training system 1 according to the present embodiment, the pulling points P1 and P2 of the walking assistance apparatus 2 which are pulled by the first and second pulling units 35 and 37 are provided to be movable around the leg portion of the user. It is possible to generate a moment force on the leg portion in the direction of the internal and external rotation by moving the pulling points P1 and P2 of the first and second pulling units 35 and 37 around the leg portion of the user and then pulling the pulling points P1 and P2. By using the moment force, it is possible to optimally adjust the control amount of the internal and external rotation of the leg portion in response to the tendency of the internal and external rotation of the leg portion of the user.

Figure 4:
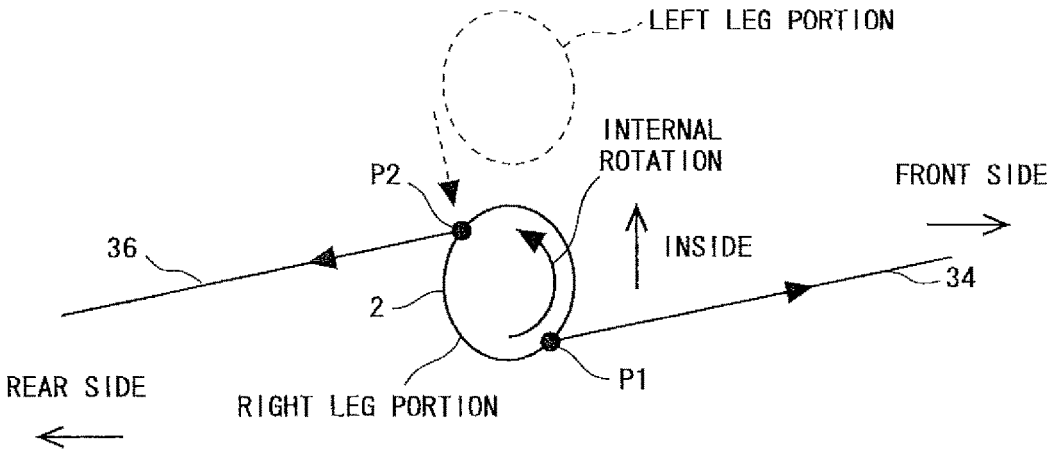
FIG. 4 is a diagram illustrating a method of adjusting a control amount of internal rotation of a leg portion.

For example, the pulling point P1 of the first pulling unit 35 is set to the outside of the leg portion of the user and/or the pulling point P2 of the second pulling unit 37 is set to the inside of the leg portion of the user. Due to this, it is possible to adjust the control amount of the internal rotation which causes the leg portion to be rotated inside (FIG. 4). More specifically, the pulling point P1 of the first pulling unit 35 can be set to further outside the leg portion of the user, and the pulling point P2 of the second pulling unit 37 can be set to further inside the leg portion of the user, thereby further increasing the control amount of the internal rotation of the leg portion.

Figure 5:
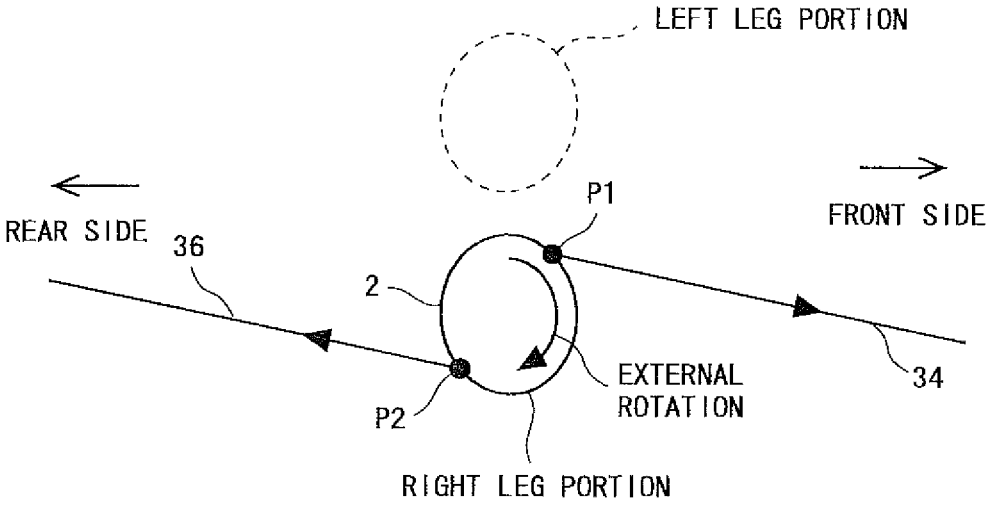
FIG. 5 is a diagram illustrating a method of adjusting a control amount of external rotation of the leg portion.

On the other hand, the pulling point P1 of the first pulling unit 35 is set to the inside of the leg portion of the user and/or the pulling point P2 of the second pulling unit 37 is set to the outside of the leg portion of the user. Due to this, it is possible to adjust the control amount of the external rotation which causes the leg portion to be rotated outside (FIG. 5). More specifically, the pulling point P1 of the first pulling unit 35 can be set to further inside the leg portion of the user, and the pulling point P2 of the second pulling unit 37 can be set to further outside the leg portion of the user, thereby further increasing the control amount of the external rotation of the leg portion. In this way, the positions of the pulling points P1 and P2 of the first and second pulling units 35 and 37 are set in accordance with the tendency of the internal and external rotation of the leg portion of the user, and thus it is possible to optimally set the control amount of the internal and external rotation.

As described above, in the walking training system 1 according to the present embodiment, the pulling points P1 and P2 on the walking assistance apparatus 2 which are pulled by the first and second pulling units 35 and 37 are provided to be movable around the leg portion of the user. It is possible to adjust the control amount of the internal and external rotation of the leg portion by moving the pulling points P1 and P2 of the first and second pulling units 35 and 37 around the leg portion of the user and then pulling the pulling points P1 and P2. That is, it is possible to adjust the control amount of the internal and external rotation of the leg portion while assisting the user's walking during the walking training.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

For example, in the above described embodiment, the pulling points P1 and P2 on the walking assistance apparatus 2 which are pulled by the first and second pulling units 35 and 37 are moved to around the leg portion of the user and thus the control amount of the internal and external rotation of the leg portion is adjusted; however, the invention is not limited thereto. At least one of the first and second pulling units 35 and 37 may be provided on the right and left frame 323 to be movable in the horizontal direction, and at least one of the first and second pulling units 35 and 37 is moved in the horizontal direction, and thus the control amount of the internal and external rotation of the leg portion is adjusted.

Figure 6:
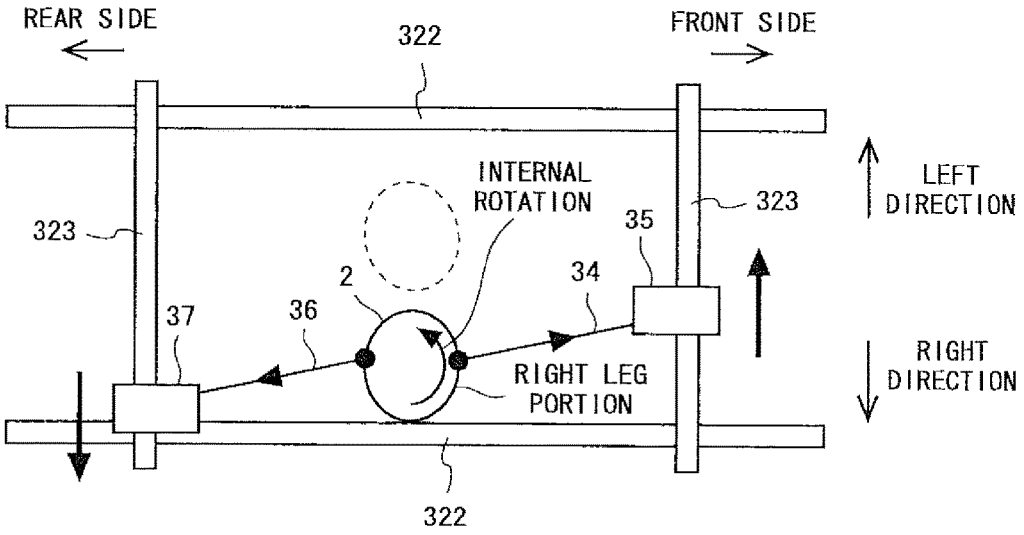
FIG. 6 is a diagram illustrating a method of adjusting the control amount of the internal rotation of the leg portion.
Figure 7:
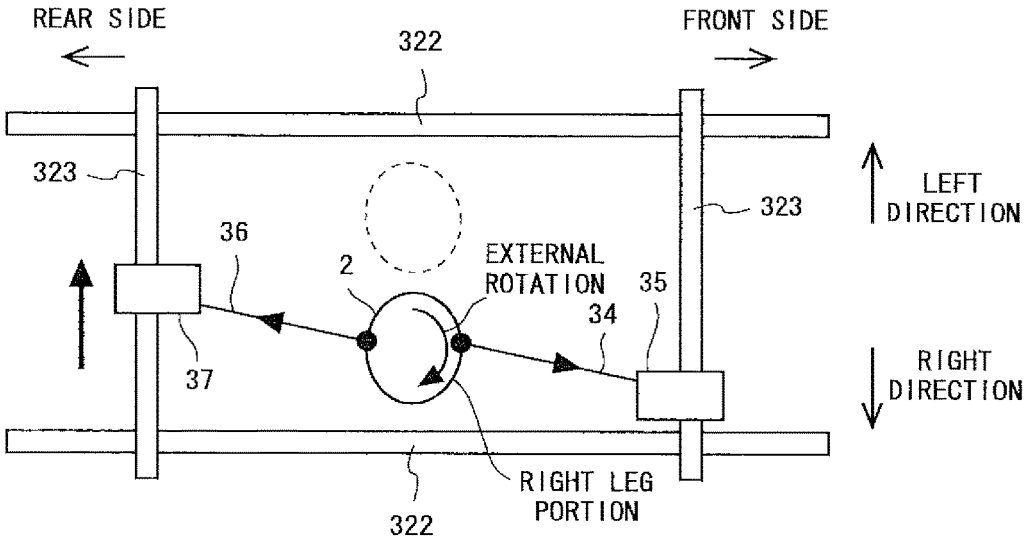
FIG. 7 is a diagram illustrating a method of adjusting the control amount of the external rotation of the leg portion.

For example, the first pulling unit 35 is moved in the left direction and the second pulling unit 37 is moved in the right direction. Due to this, it is possible to generate the moment force in the internal rotation direction in the leg portion, and thus control the external rotation of the leg portion (FIG. 6). On the other hand, the first pulling unit 35 is moved in the right direction and the second pulling unit 37 is moved in the left direction. Due to this, it is possible to generate the moment force in the external rotation direction in the leg portion, and thus control the internal rotation of the leg portion (FIG. 7). In addition, it is possible to increase the control amount of the internal and external rotation by setting the movement amount of the first and second pulling units 35 and 37 to be large in the horizontal direction. In this way, the movement positions of the first and second pulling units 35 and 37 in the horizontal direction are set in accordance with the tendency of the internal and external rotation of the leg portion of the user, and thus it is possible to optimally set the control amount of the internal and external rotation.

In the above described embodiment, the first pulling unit 35 pulls the walking assistance apparatus 2 to the upper side and the front side via the wire 34, and the second pulling unit 37 pulls the walking assistance apparatus 2 to the upper side and the rear side via the wire 36; however, the invention is not limited thereto. For example, the first pulling unit 35 may pull the walking assistance apparatus 2 to the front side via the wire 34, and the second pulling unit 37 may pull the walking assistance apparatus 2 to the rear side via the wire 36.

In the above described embodiment, the training apparatus 3 may not include the frame main body 32. In this case, the first and second pulling units 35 and 37 may be provided on, for example, a wall or ceiling.

In the above described embodiment, the wires 34 and 36 of the first and second pulling units 35 and 37 are connected to the walking assistance apparatus 2; however, the invention is not limited thereto. For example, the wires 34 and 36 of the first and second pulling units 35 and 37 may be connected to the leg portion of the user via a mounting tool such as a belt and a ring. Further, the wires 34 and 36 of the first and second pulling units 35 and 37 may be connected to the walking assistance apparatus 2 and the leg portion of the user.

In the above described embodiment, the user who wears the walking assistance apparatus 2 walks on the treadmill 31; however, the invention is not limited thereto. The user who wears the walking assistance apparatus 2 may walk on a stationary road, and the first and second pulling units 35 and 37 may be moved in accordance with the movement of the user.

What is claimed is:

1. A walking training system comprising:

a walking assistance apparatus that is configured to be mounted on a leg portion of a user to assist the user's walking;

first pulling means for pulling at least one of the walking assistance apparatus and the leg portion of the user to a front side and an upper side;

second pulling means for pulling at least one of the walking assistance apparatus and the leg portion of the user to a rear side and the upper side; and a control apparatus that controls the first pulling means and the second pulling means, wherein:

a first pulling point of the walking assistance apparatus and/or the leg portion of the user, which is pulled by the first pulling means, is movable around the leg portion of the user, a second pulling point of the walking assistance apparatus and/or the leg portion of the user, which is pulled by the second pulling means, is movable around the leg portion of the user, the first pulling point and the second pulling point each generate a moment force on the leg portion of the user in a direction of an internal or external rotation to counteract an amount of internal or external rotation of the leg portion of the user, the first pulling means and the second pulling means together generate a pulling force in a vertical direction to reduce a weight of the walking assistance apparatus, each of the first and second pulling means includes a wire of which an end is attached to at least one of the walking assistance apparatus and the leg portion of the user, and a pulling unit that pulls the wire, when the walking assistance apparatus is mounted on a right leg portion, the control apparatus controls the pulling unit of the first pulling means to move in a left direction, controls the pulling unit of the second pulling means to move in a right direction, generates the moment force on the leg portion in an internal rotation direction, controls external rotation of the leg portion, controls the pulling unit of the first pulling means to move in the right direction, controls the pulling unit of the second pulling means in the left direction, generates the moment force on the leg portion in an external rotation direction, and controls internal rotation of the leg portion, when the walking assistance apparatus is mounted on a left leg portion, the control apparatus controls the pulling unit of the first pulling means to move in the right direction, controls the pulling unit of the second pulling means to move in the left direction, generates the moment force on the leg portion in the internal rotation direction, controls the external rotation of the leg portion, controls the pulling unit of the first pulling means to move in the left direction, controls the pulling unit of the second pulling means in the right direction, generates the moment force on the leg portion in the external rotation direction, and controls the internal rotation of the leg portion, the control apparatus increases a movement amount of the first pulling means and the second pulling means to thereby increase the control amount of the internal and external rotation, and each of the pulling units of the first pulling means and the second pulling means includes an actuator that winds and rewinds the wire.

2. The walking training system according to claim 1, wherein the first pulling point is set to an outside of the leg portion of the user and/or the second pulling point is set to an inside of the leg portion of the user.

3. The walking training system according to claim 1, wherein the first pulling point is set to an inside of the leg portion of the user and/or the second pulling point is set to an outside of the leg portion of the user.

4. The walking training system according to claim 1, wherein the pulling unit is movable in a horizontal direction.

5. The walking training system according to claim 1, wherein:

the first pulling means pulls at least one of the walking assistance apparatus and the leg portion of the user to the upper side and the front side, and the second pulling means pulls at least one of the walking assistance apparatus and the leg portion of the user to the upper side and the rear side.

6. The walking training system according to claim 1, wherein the control apparatus independently controls the first pulling means and the second pulling means.

7. The walking training system according to claim 1, wherein a resultant force of components in the vertically upward direction from the pulling forces that are generated by the first pulling means and the second pulling means is equal to the force of gravity of the walking assistance apparatus.

8. A walking training system comprising:

a walking assistance apparatus that is configured to be mounted on a leg portion of a user to assist the user's walking;

first pulling means for pulling at least one of the walking assistance apparatus and the leg portion of the user to a front side;

second pulling means for pulling at least one of the walking assistance apparatus and the leg portion of the user to a rear side; and a control apparatus that controls the first pulling means and the second pulling means, wherein:

the first pulling means and the second pulling means together generate a pulling force in a vertical direction that is at least equal to a weight of the walking assistance apparatus, each of the first pulling means and the second pulling means includes a wire, an end of each wire is attached to at least one of the walking assistance apparatus and the leg portion of the user, the first pulling means and the second pulling means each includes a pulling unit that pulls the wire, at least one of the pulling units of the first pulling means and the second pulling means is movable in a horizontal direction, when the walking assistance apparatus is mounted on a right leg portion, the control apparatus controls the pulling unit of the first pulling means to move in a left direction, controls the pulling unit of the second pulling means to move in a right direction, generates the moment force on the leg portion in an internal rotation direction, controls external rotation of the leg portion, controls the pulling unit of the first pulling means to move in the right direction, controls the pulling unit of the second pulling means in the left direction, generates the moment force on the leg portion in an external rotation direction, and controls internal rotation of the leg portion, when the walking assistance apparatus is mounted on a left leg portion, the control apparatus controls the pulling unit of the first pulling means to move in the right direction, controls the pulling unit of the second pulling means to move in the left direction, generates the moment force on the leg portion in the internal rotation direction, controls the external rotation of the leg portion, controls the pulling unit of the first pulling means to move in the left direction, controls the pulling unit of the second pulling means in the right direction, generates the moment force on the leg portion in the external rotation direction, and controls the internal rotation of the leg portion, the control apparatus increases a movement amount of the first pulling means and the second pulling means to thereby increase the control amount of the internal and external rotation, and each of the pulling units of the first pulling means and the second pulling means includes an actuator that winds and rewinds the wire.

9. A walking training method of a walking training system that includes a walking assistance apparatus that is mounted on a leg portion of a user to assist the user's walking; first pulling means for pulling at least one of the walking assistance apparatus and the leg portion of the user to a front side; second pulling means for pulling at least one of the walking assistance apparatus and the leg portion of the user to a rear side; and a control apparatus that controls the first pulling means and the second pulling means, the method comprising:

setting a first pulling point of the walking assistance apparatus and/or the leg portion of the user that is pulled by the first pulling means by moving the first pulling point around the leg portion of the user, setting a second pulling point of the walking assistance apparatus and/or the leg portion of the user that is pulled by moving the second pulling point around the leg portion of the user, generating a moment force on the leg portion of the user with the first pulling point and the second pulling point, the moment force being in a direction of an internal or external rotation to counteract an amount of internal or external rotation of the leg portion of the user, generating a pulling force in a vertical direction with the first pulling means and the second pulling means together, the pulling force being at least equal to a weight of the walking assistance apparatus, wherein:

each of the first and second pulling means includes a wire of which an end is attached to at least one of the walking assistance apparatus and the leg portion of the user, and a pulling unit that pulls the wire, when the walking assistance apparatus is mounted on a right leg portion, the control apparatus controls the pulling unit of the first pulling means to move in a left direction, controls the pulling unit of the second pulling means to move in a right direction, generates the moment force on the leg portion in an internal rotation direction, controls external rotation of the leg portion, controls the pulling unit of the first pulling means to move in the right direction, controls the pulling unit of the second pulling means in the left direction, generates the moment force on the leg portion in an external rotation direction, and controls internal rotation of the leg portion, when the walking assistance apparatus is mounted on a left leg portion, the control apparatus controls the pulling unit of the first pulling means to move in the right direction, controls the pulling unit of the second pulling means to move in the left direction, generates the moment force on the leg portion in the internal rotation direction, controls the external rotation of the leg portion, controls the pulling unit of the first pulling means to move in the left direction, controls the pulling unit of the second pulling means in the right direction, generates the moment force on the leg portion in the external rotation direction, and controls the internal rotation of the leg portion, the control apparatus increases a movement amount of the first pulling means and the second pulling means to thereby increase the control amount of the internal and external rotation, and each of the pulling units of the first pulling means and the second pulling means includes an actuator that winds and rewinds the wire.

* * * * *